US008550865B2

(12) United States Patent
Uegaki et al.

(10) Patent No.: US 8,550,865 B2
(45) Date of Patent: Oct. 8, 2013

(54) SPARK PLUG MANUFACTURING METHOD

(75) Inventors: Hironori Uegaki, Nagoya (JP); Toshitaka Honda, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 13/440,040

(22) Filed: Apr. 5, 2012

(65) Prior Publication Data

US 2012/0258644 A1 Oct. 11, 2012

(30) Foreign Application Priority Data

Apr. 5, 2011 (JP) ..... 2011-083894

(51) Int. Cl.
*H01T 13/38* (2006.01)

(52) U.S. Cl.
USPC ..... 445/7; 313/118

(58) Field of Classification Search
USPC ..... 313/118–145; 445/7
See application file for complete search history.

(56) References Cited

U.S. PATENT DOCUMENTS

| | | | | |
|---|---|---|---|---|
| 3,551,242 | A * | 12/1970 | Boeke | 156/244.19 |
| 4,978,516 | A | 12/1990 | Yamada et al. | |
| 6,366,008 | B1 | 4/2002 | Fukushima et al. | |
| 2002/0041135 | A1 * | 4/2002 | Fukushima et al. | 313/118 |

FOREIGN PATENT DOCUMENTS

| | | | |
|---|---|---|---|
| JP | 64-111711 | A | 4/1989 |
| JP | 2002-083664 | A | 3/2002 |
| JP | 2007-141868 | A | 6/2007 |
| JP | 2007-151875 | A | 6/2007 |
| JP | 2010-198809 | A | 9/2010 |

OTHER PUBLICATIONS

Office Action mailed Apr. 12, 2013 for the corresponding Japanese Patent Application No. 2011-083894.

* cited by examiner

*Primary Examiner* — Nimeshkumar Patel
*Assistant Examiner* — Christopher Raabe
(74) *Attorney, Agent, or Firm* — Leason Ellis LLP.

(57) ABSTRACT

A spark plug manufacturing method provides a reduction in the cost of raw material preparation and the cost of the disposal of unused powder by recycling powder not used in forming a filler layer of another spark plug. The method is used to make a spark plug that includes a metal shell having a through hole, and an insulating body held inside the through hole, and a filler layer containing talc in a space surrounded by an inner peripheral surface of the through hole and an outer peripheral surface of the insulating body. The powder not used in a process of forming a filler layer of another spark plug is recycled for forming the filler layer of the present spark plug, where the forming process is performed after talc and a binder are mixed.

4 Claims, 4 Drawing Sheets

SPARK PLUG MANUFACTURING METHOD

CROSS-REFERENCE TO RELATED PATENT APPLICATIONS

This application claims the benefit of Japanese Patent Application No. 2011-83894, filed Apr. 5, 2011, which is incorporated by reference herein.

FIELD OF THE INVENTION

The present invention relates to a method of manufacturing a spark plug used for an ignition of an internal combustion engine, and particularly, to a spark plug manufacturing method whereby a talc-based seal material is recycled.

BACKGROUND OF THE INVENTION

A spark plug used for an ignition of an internal combustion engine, such as an automotive engine, generally includes a hollow cylindrical metal shell, a hollow cylindrical insulating body disposed in an inner hole of the metal shell, a center electrode disposed on the leading end side in an axial hole of the insulating body, a terminal disposed on the other end side in the axial hole, and a ground electrode of which one end is joined to the leading end side of the metal shell, and the other end, being opposed to the center electrode, forms a spark discharge gap. Also, a spark plug in which is provided a filler layer wherein an annular space between an inner peripheral surface of the metal shell and an outer peripheral surface of the insulating body is filled with a talc-based filler, in order to prevent a leakage of a gas from a combustion chamber in which the spark plug is installed, is known.

One example of a method of forming this filler layer is described in JP-A-2002-83664 in the following way. "A raw powder manufacturing process whereby raw powder LP is manufactured by combining a specified amount of liquid glass WG and water W with talc powder TP, and mixing and agitating this combination is carried out." (Paragraph 0027). "The raw powder LP is granulated for an improvement in fluidity, providing granulated filler powder GP." (refer to Paragraph 0029). "A cavity of a mold 100 is filled with the granulated filler powder GP, . . . , making a compact PC of filler powder." (refer to Paragraph 0030). "The filler powder is inserted into a space in the form of the compact PC, thus forming a powder filler layer . . . after the insertion of the compact PC, a compression step which compresses the compact PC (powder filler layer) in a direction of the axis of the metal shell 1 is implemented." (refer to Paragraphs 0034 and 0035). "A caulked portion id is formed by caulking the rear end side rim of the metal shell 1 toward the insulating body while bending it inward by compressing it in the direction of the axis. A seal filler layer 61 is maintained in a compressed condition owing to the formation of the caulked portion id, thus continuously achieving a good sealing property." (refer to Paragraph 0036).

When forming a seal filler layer, whether with the manufacturing method described in JP-A-2002-83664 or not, it not being possible to form the seal filler layer by using all of initially prepared raw powder with no waste, there exists a large amount of raw powder disposed of partway through the manufacturing process.

SUMMARY OF THE INVENTION

The invention has an object of providing a spark plug manufacturing method whereby it is possible to reduce a raw material cost and an unused powder disposal cost by recycling powder not used informing a filler layer of another spark plug.

A way for achieving the object is:

1. A method of manufacturing a spark plug which includes a metal shell having a through hole, and an insulating body held inside the through hole, and including a filler layer containing talc in a space surrounded by an inner peripheral surface of the through hole and an outer peripheral surface of the insulating body, wherein powder not used in the process of forming a filler layer of another spark plug is recycled for forming the filler layer of the spark plug of the invention, while the process of forming the filler layer of the other spark plug is performed after talc and a binder are mixed in the filler layer of the other spark plug.

Preferred aspects of 1 are:

2. The unused powder is prepared in a preparation step including a particle size regulation step which grinds the unused powder and regulates the particle size, and a binder mixing step which mixes regulated unused powder obtained in the particle size regulation step and a binder.

3. The particle size of the unused powder is regulated such that the frequency of the unused powder of 1000 μm or more in particle size distribution is 4 wt % or less.

4. The particle size of the unused powder is regulated such that the frequency of the unused powder of 45 μm or less in particle size distribution is 52 wt % or less.

5. The preparation step includes a deironization step which removes iron from the unused powder or the regulated unused powder before the binder mixing step.

6. Deironized powder obtained after the deironization step has the iron content of 31 ppm or less.

According to the spark plug manufacturing method of the invention, it is possible to provide a spark plug manufacturing method whereby, as a powder not used in forming a filler layer of another spark plug is recycled, it is possible to reduce a raw material cost and an unused powder disposal cost.

According to the spark plug manufacturing method of the invention, as the unused powder is prepared in the preparation step including the particle size regulation step and binder mixing step, and particularly, the particle size of the unused powder is regulated within the heretofore described predetermined range, it is possible to obtain a high-density filler layer, and it is thus possible to secure a good sealing property between the metal shell and insulating body.

According to the spark plug manufacturing method of the invention, as the deironization step is performed before the binder mixing step, and particularly, the iron content of the deironized powder is set to 31 ppm or less in the deironization step, it is possible to obtain an even and high-density filler layer, and it is possible to secure a still better sealing property.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
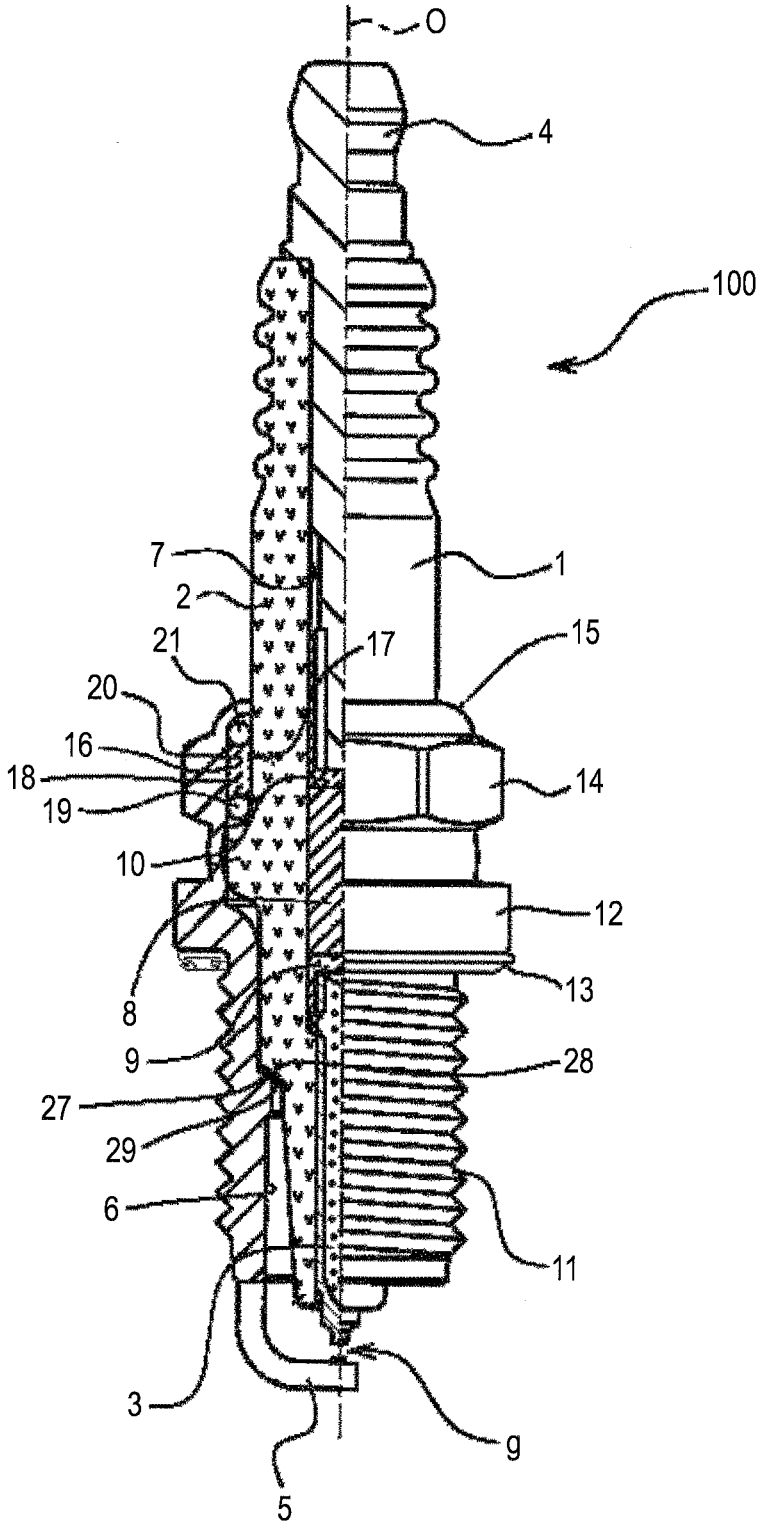
FIG. 1 is a sectional overall illustration of one embodiment of a spark plug of the present invention.
Figure 2:
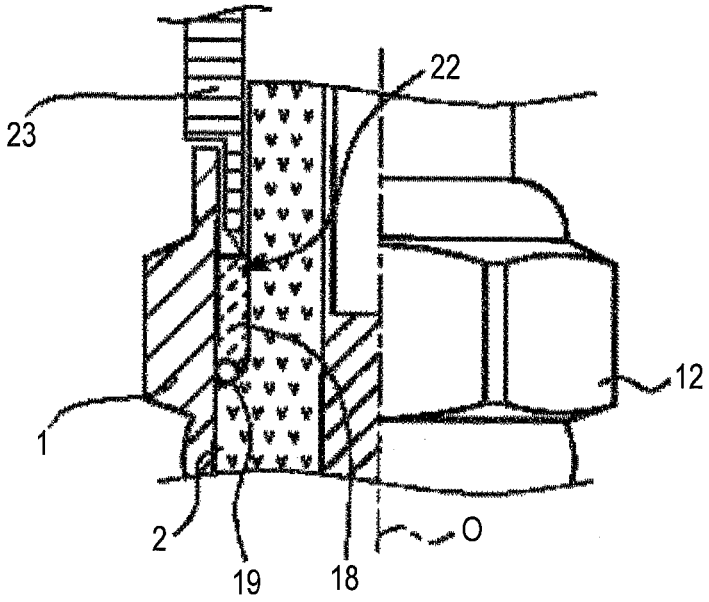
FIG. 2 is a sectional illustration of a main portion of the spark plug showing a step of cutting a preform with a cutting tool in a process of forming a filler layer of a spark plug.

As shown in FIG. 1, a spark plug 100 normally includes a metal shell 1 having a through hole 6, an insulating body 2, held in the through hole 6, which has an axial hole 7, a center electrode 3 held on one end side in the axial hole 7, a terminal 4 held on the other end side in the axial hole 7, and a ground electrode 5 of which one end is joined to the leading end face of the metal shell 1, and the other end is disposed so as to be opposed to the center electrode 3 across a gap.

The insulating body 2 is formed from a material with mechanical strength, thermal strength, electrical strength, and the like, for example, a sintered ceramic based on alumina, is of an approximately hollow cylindrical shape, and has the axial hole 7 extending in a direction of an axis O. The approximately cylindrical center electrode 3 formed from an Ni-based alloy or the like is held on the one end side in the axial hole 7, and the approximately cylindrical terminal 4 formed from a low-carbon steel or the like is held on the other end side in the axial hole 7. A resistor 8 is provided between the center electrode 3 and terminal 4 in the axial hole 7, as necessary, in order to suppress an occurrence of radio noise, and conductive glass seal layers 9 and 10 are provided one at either end of the resistor 8, thus electrically connecting the center electrode 3 and terminal 4.

The metal shell 1 is formed from a conductive steel material, such as a low-carbon steel, has an approximately hollow cylindrical shape, and is formed in such a way as to house and hold the insulating body 2. A threaded portion 11 is formed on the leading end direction outer peripheral surface of the metal shell 1, and the spark plug is mounted in a cylinder head of an unshown internal combustion engine utilizing the threaded portion 11. A flange-like gas seal portion 12 is formed on the rear end side of the threaded portion 11, and a gasket 13 is fitted between the gas seal portion 12 and threaded portion 11. The gasket 13 is a ring-like part into which a metal plate of carbon steel or the like is bent and, by screwing the threaded portion 11 into a cylinder head side threaded bore, is compressed in the direction of the axis O between the gas seal portion 12 and an opening perimeter portion of the threaded bore, sealing a clearance between the threaded bore and the threaded portion 11. A tool engagement portion 14 with which a tool, such as a spanner or a wrench, is engaged is formed on the rear end side of the gas seal portion 12, and a caulked portion 15 is formed on the rear end side of the tool engagement portion 14. A ring-like packing 19, a talc-based filler layer 20, and a ring-like packing 21 are disposed, sequentially from the leading end side, in an annular space 18 formed between an inner peripheral surface 16 of the caulked portion 15 and tool engagement portion 14 and an outer peripheral surface 17 of the insulating body 2, and the insulating body 2 is fixed to the metal shell 1. By the filler layer 20 being provided, it is possible to secure a good sealing property between the metal shell 1 and insulating body 2 even when the spark plug 100 receives an impact.

The filler layer 20 contains talc and a binder.

Talc is a material which, as it is inexpensive and also has a low coefficient of friction with metal, is widely used as a lubricant. Talc, as it has a good compressibility and slipperiness over the inner peripheral surface 16 of the main shell 1, and furthermore, also has good insulation and thermal resistance properties, can be suitably used as a spark plug seal material.

A binder is preferably a material which is in a liquid state at ordinary temperature and has a boiling point of 150° C. or more. This kind of material can include, for example, an inorganic substance such as liquid glass, colloidal silica, or aluminum phosphate, or silicone such as silicone oil or silicone varnish. When an inorganic substance or silicone is used as a binder, the filler layer 20 is not easily deteriorated even under harsh conditions such as high temperature, because a highly compressed state is maintained under high temperature, securing the sealing property. A binder is contained in the filler layer in a certain range such that the high density of the filler layer 20 can be obtained, and that in a formation process the powder including the binder can be easily handled thanks to an appropriate fluidity provided to the powder.

Next, a general formation method of the filler layer 20 will be described.

Firstly, talc is ground, talc powder having a predetermined particle size distribution is prepared, a predetermined amount of binder is added to the talc powder, and they are mixed by a kneading machine, preparing mixed powder (a mixing step).

Next, a compact is formed by compressing the mixed powder with a roll press or the like. The compact is disintegrated, and coarsely ground to a predetermined particle size. The average particle size of disintegrated powder coarsely ground is larger than the average particle size of the talc powder, and the disintegrated powder exists in the state of secondary particles (an agglomerate) formed by the talc powder which is of primary particles agglomerating. Next, the disintegrated powder is classified using a sieve, and only particles having a predetermined range of particle sizes are collected, obtaining granulated powder (a granulation step).

Meanwhile, the insulating body 2 on which are mounted the center electrode 3, resistor 8, terminal 4, and the like, is inserted from the rear end side of the through hole 6 of the metal shell 1, and disposed in such a way that a ledge portion 27 provided in the through hole 6 and a stepped portion 28 provided on the outer peripheral surface of the insulating body 2 abut across a plate packing 29. As an annular space 18 is formed between the rear end side inner peripheral surface 16 of the through hole 6 and the outer peripheral surface 17 of the insulating body 2 at this time, the ring-like packing 19 is inserted into the space 18, and next, the space 18 is filled with the obtained granulated powder.

The space 18 can be filled with the granulated powder by various methods (a filling step). Examples include a method of filling the space 18 directly with the granulated powder, and a method of, after forming a ring-like preform by filling a mold with the granulated powder, inserting the preform into the space 18. By any method, a filler with which the space 18 is filled is compressed in the direction of the axis O by a press, forming the filler layer 20. Subsequently, excess filler is cut using a cutting tool 23 in such a way that the filler layer 20 is of a predetermined height.

Next, the ring-like packing 21 is disposed in such a way as to come into contact with the filler layer 20 and, by caulking the rear end side rim portion of the metal shell 1 inward toward the packing 21, an appropriately compressed filler layer 20 is formed, the caulked portion 15 is formed, and the insulating body 2 is fixed to the metal shell 1.

Not all talc powder initially prepared to form the filler layer 20 is used, while a portion of the talc powder fails to be used for forming the filler layer 20 during each of the above-mentioned steps, thereby being discarded as a result. Powders not used in forming the filler layer 20 include; for example, a powder not used to obtain a desired particle size distribution in the granulation step, a powder not used as it is pushed aside outside the space 18 when filling the space 18 with the granulated powder, a powder not used as it is pushed aside outside the mold when forming the preform 22, a powder not used as it is cut away in order to form the filler layer 20 to a desired height after the space 18 has been filled with the granulated powder or the preform, and the like.

As described above, powders not used in forming the filler layer 20 after the process of mixing talc and a binder have been disposed of up until now. However, according to a spark plug manufacturing method of the invention, because the unused powder is recycled to form a filler layer of another spark plug, it is possible to reduce a raw material cost and unused powder disposal cost, and it is possible to save the trouble of waste disposal owing to decreasing waste.

Figure 3:
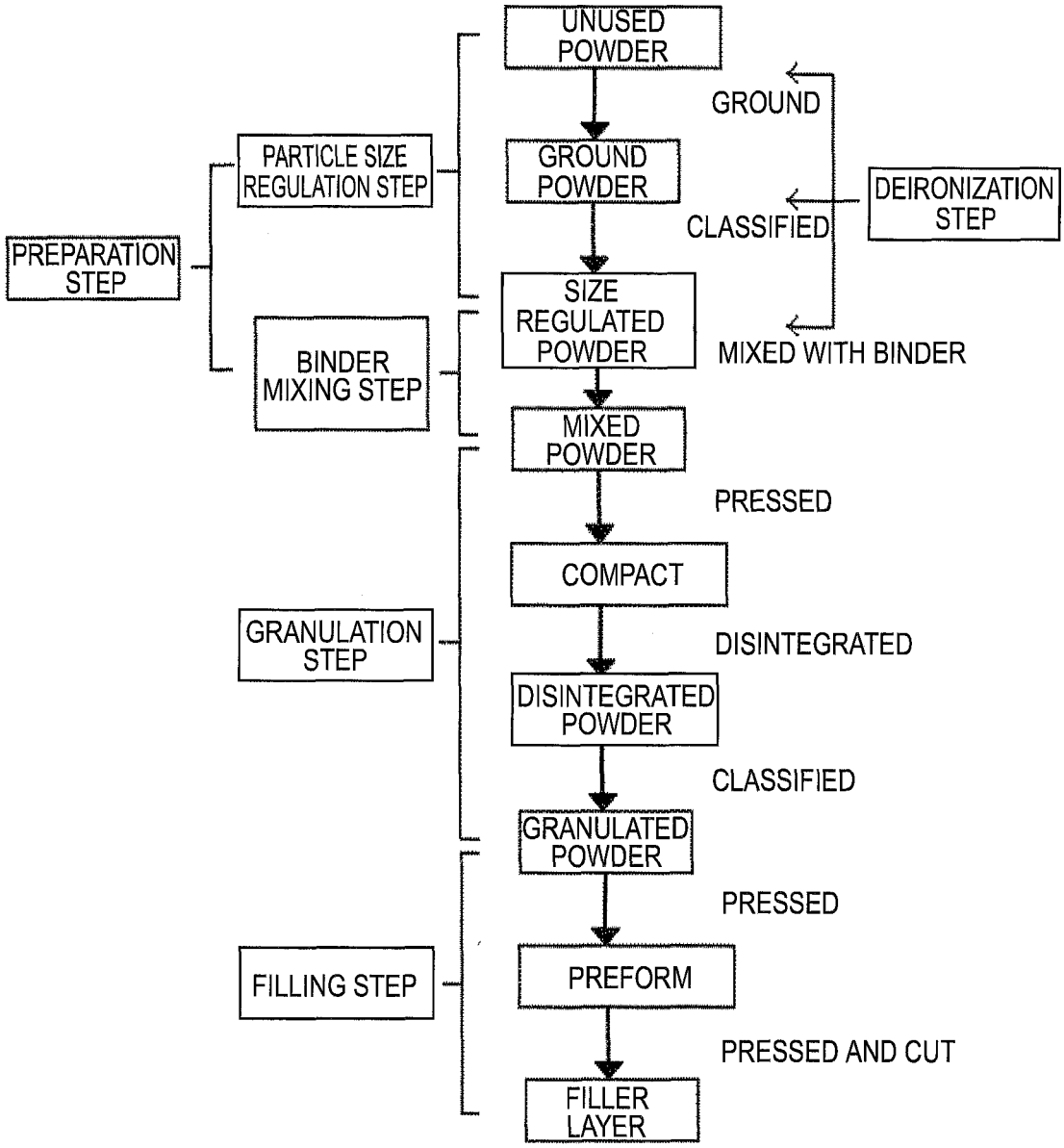
FIG. 3 is a flowchart of a filler layer formation process including a preparation step which prepares unused powder.

FIG. 3 shows a flowchart of a filler layer formation process including a preparation step which prepares unused powder. As the structure of a spark plug manufactured by the spark plug manufacturing method of the invention is not particularly limited, provided that it has a talc-based filler layer, the spark plug shown in FIG. 1, described as one example of a spark plug, is referred to as appropriate in the following description, and reference numerals and signs the same as those of the members shown in FIG. 1 are used.

When recycling unused powder as a filler forming the filler layer 20 of another spark plug 100, it is preferable to recycle unused powder after preparing it in the preparation step including a binder mixing step which mixes unused powder and a binder, and coats the surface of unused powder particles with the binder, rather than recycling unused powder as it is. Normally, when forming the preform 22 after mixing talc powder and a binder, the strength of the preform 22 is increased by carrying out a drying and hardening the binder in order to prevent the preform 22 from being broken partway through the step. Among binders, there is a binder which, once it is dried, loses its function, and loses the binding strength. Consequently, when forming the preform 22 for being used in another spark plug using this kind of unused powder which has lost the binding strength, it may not be possible to obtain a preform 22 having a sufficient strength without any crack, chip, or the like. Consequently, it is preferable to recycle unused powder after the binder mixing step, which mixes unused powder and a binder, in order to strengthen the bonding strength of particles. This aspect is a case in which unused powder is prepared in the preparation step including only the binder mixing step in the flowchart shown in FIG. 3.

Figure 4A:
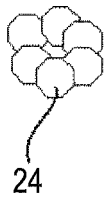
FIGS. 4A to 4D are illustrations showing a condition in which unused powder is coated with a binder when the unused powder and binder are mixed without grinding the unused powder.
Figure 4B:
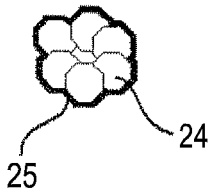
Figure 4C:
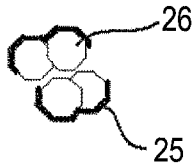
Figure 4D:
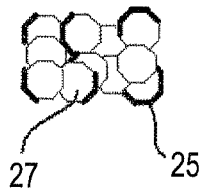

Also, it is more preferable to recycle unused powder after preparing it in a preparation step including a particle size regulation step which grinds unused powder and regulates the particle size, and a binder mixing step which mixes regulated unused powder obtained in the particle size regulation step and a binder. As unused powder is an agglomerate of primary particles, the particle size of unused powder is comparatively large. When a predetermined amount of binder 25 is added with unused powder 24 whose particles remain thus coarse as a raw material, as shown in FIGS. 4A to 4D, only the surface of the coarse particles is coated with the binder 25 (FIG. 4B). When these particles are coarsely ground after they have been compressed to form the compact in the granulation step, it may happen that a surface not coated with the binder 25 appears on the surface of secondary particles 26 (FIG. 4C). When a preform 27 is formed using this kind of secondary particle 26, the bonding strength on the surface not coated with the binder 25 decreases, meaning that a breakage or chip originating on this surface becomes liable to occur (FIG. 4D). However, when the preform 22 is formed after unused powder has been prepared passing through the particle size regulation step and binder mixing step, a preform 22 having a suitable density and strength is obtained, meaning that it is possible to prevent a crack or chip of the preform 22, as a result of which it is possible to prevent a material shortage when the space 18 is filled with the preform 22, and it is possible to manufacture a spark plug 100 having a good sealing property by the amount of filler forming the filler layer 20 reaching a predetermined amount.

In the particle size regulation step, it is preferable to form ground powder by grinding unused powder to a particle size equivalent to that of primary particles, that is, talc powder. It is preferable, furthermore, to form regulated unused powder having a desired particle size distribution by classifying this ground powder using a sieve or the like.

It is preferable that the particle size of the unused powder is regulated such that the frequency of the unused powder of 1000 μm or more in particle size distribution is 4 wt % or less, and/or the frequency of the unused powder of 45 μm or less is 52 wt % or less. When the frequency of the regulated unused powder of 1000 μm or more is 4 wt % or less, it is possible, in the binder mixing step which mixes the size regulated powder and a binder, to coat the surface of each of primary particles with the binder. Also, when the frequency of the regulated unused powder of 45 μm or less is 52 wt % or less, it is possible to obtain a preform 22 having a suitable density, while the density of the preform 22 is liable to decrease when the frequency of a small particle size is too high. Therefore, when the particle size of the regulated powder has said particle size distribution, a preform 22 with more suitable density and strength is obtained, meaning that it is possible to prevent a crack or chip of the preform 22, as a result of which it is possible to prevent a material shortage when the space 18 is filled with the preform 22, and it is possible to manufacture a spark plug 100 having a better sealing property by the amount of filler forming the filler layer 20 reaching a predetermined amount.

In the binder mixing step, it is most preferable to mix the regulated powder obtained in the particle size regulation step and a binder, but unused powder or ground powder may be mixed with a binder. As a binder used in the binder mixing step, it is possible to use a binder selected from the binders described in the above section that explains the formation method of the filler layer 20 of another spark plug. A binder content is appropriately adjusted in such a way that the density of the filler layer 20 can be increased, and powder including the binder can be handled easily in the formation step of the filler layer 20 thanks to an appropriate fluidity.

It is preferable that the preparation step includes a deironization step which removes iron from unused powder or the size regulated powder before the binder mixing step. For example, iron originating in powder from the metal shell 1 produced by a friction between a cutting tool 23 used and the metal shell 1, and iron originating in powder from a cutting blade of the cutting tool 23 produced by wear of the cutting blade, are included in the unused powder as it is cut away from the filler layer 20. There is a danger that pressure propagation in a filler containing comparatively more iron is inhibited when the filler is pressed, and the filler is partially compressed due to the propagation inhibition, forming an unevenly compressed preform 22 or filler layer 20. Also, when cutting a filler layer 20 containing comparatively more iron using the cutting tool 23, the cutting tool 23 is worn down by iron included in a filler, and the lifespan of the cutting tool 23 is shortened. Consequently, when iron is removed from a recycled filler by passing through the deironization step, it is preferable because it is possible to obtain an even and high-density filler layer 20, and it is also possible to prevent a decrease in the lifespan of the cutting tool 23.

It is preferable that the deironization step is carried out on ground powder wherein unused powder is ground into primary particles, or size regulated powder wherein the ground powder is classified into desired particle size ranges. When unused powder is, for example, unused powder produced by cutting the filler layer 20, as the unused powder is an agglomerate, as previously described, it is difficult to remove iron existing inside the agglomerate, while it is easy to remove iron when a deironization is carried out on ground powder ground into primary particles by grinding unused powder or size regulated powder wherein the ground powder is classified.

It is preferable that deironized powder obtained after the deironization step has an iron content of 31 ppm or less, and 10 ppm or less is particularly preferable. The less the iron content, the more preferable, as previously described, and an even and high-density filler layer 20 is obtained when the iron content is 31 ppm or less, and particularly, 10 ppm or less.

An iron removal can be carried out by passing an electromagnet through unused powder, ground powder, or size regulated powder.

An iron content with respect to a total ironized powder mass is measured by a chemical analysis.

When forming the filler layer 20 after forming the preform 22 in advance, it is preferable that the density of the preform 22 is higher than 2.05 g/cm$^3$, and it is more preferable that it is 2.15 g/cm$^3$ or more. When the density of the preform 22 is within the previously mentioned range, it is difficult for a crack or chip of the preform to occur when moving the preform 22 in the steps until the space 18 is filled.

It is preferable that the strength of the preform 22 is 100 gf or more. When the strength of the perform 22 is within the previously mentioned range, it is possible to prevent a crack or chip of the preform 22 from occurring. When the filler layer 20 is formed from a preform 22 without any crack or chip, it is possible to prevent a material shortage due to the crack or chip.

The strength of the preform 22 can be measured by a digital force gauge (by IMADA).

When forming the filler layer 20 of another spark plug using unused powder, the filler layer 20 may be formed from only unused powder, or the filler layer 20 may be formed by containing unused powder, together with newly prepared talc powder, within a range of, for example, 5 to 50 wt % of the talc powder.

A spark plug manufactured by the spark plug manufacturing method according to the invention is used as an ignition plug of an internal combustion engine, for example, a gasoline engine, for an automobile, and is fixed in a predetermined position by the threaded portion 11 being screwed into a threaded bore provided in a head (not shown) defining and forming a combustion chamber of the internal combustion engine.

The spark plug manufacturing method according to the invention, not being limited to the heretofore described embodiment, can be variously changed within a scope in which the subject of the invention can be achieved.

Working Example

Fabrication of Preform

In the process of forming the filler layer 20 of the spark plug shown in FIG. 1, a preform for being recycled used in another spark plug is fabricated using unused powder produced when cutting a filler with which the space 18 is filled. Prepared powder is obtained by passing through the particle size regulation step which grinds the unused powder and regulates the particle size, the deironization step which removes iron from the unused powder, and the binder mixing step which mixes the unused powder and a binder. Next, the prepared powder obtained is roll pressed to form a compact, the compact is disintegrated and coarsely ground to a predetermined particle size, and disintegrated powder obtained is classified using a sieve, thus obtaining granulated powder. The granulated powder is loaded into a mold and pressed, fabricating a preform.

In the particle size regulation step, size regulated powder having various particle sizes is obtained in the following way. That is, the unused powder is ground under conditions of a blade roller revolution of 3600 rpm and a screen mesh of ϕ1.0, obtaining ground powder having various particle size distributions, and the ground powder is classified using a sieve with openings of 1000 μm and a sieve with openings of 45 μm, and the frequency of particles remaining in the sieve with openings of 1000 μm and the frequency of particles passing through the sieve with openings of 45 μm are each calculated. Results are shown in Table 1 and Table 2.

In the deironization step, iron is removed by passing an electromagnet through the size regulated powder, and an iron removal rate is changed by causing the output of the electromagnet to vary. The content of iron in deironized powder is measured by a chemical analysis. Results are shown in Table 3.

The unused powder contains 89 ppm of iron per 100 g. In the binder mixing step, liquid glass is used as a binder, and 5 wt % of binder is mixed in the deironized powder. Iron is removed from the size regulated powder in Table 1 and Table 2 by the electromagnet, and an iron content is about 10 ppm. Also, the frequency of the regulated powder of 45 μm or less in Table 1 is about 30 wt %, the frequency of the regulated powder of 1000 μm or more in Table 2 is about 2 wt %, and the frequency of the regulated powder of 1000 μm or more, and the frequency of the regulated powder of 45 μm or less in Table 3 are 30 wt % and 2 wt % respectively.

Evaluation Method

Density of Preform

The density of the preform is calculated by measuring the mass of the preform and dividing the mass by the volume of the preform.

Strength of Preform

The strength of the preform is measured using a digital force gauge (by IMADA).

Occurrence of Crack or Chip of Preform

The preform is visually observed, checking the presence or absence of a crack or chip.

These evaluation results are shown in Tables 1 to 3.

TABLE 1

| Test number | Frequency (wt %) of 1000 μm or more | Density (g/cm$^3$) | Strength (gf) | Occurrence of crack or chip |
|---|---|---|---|---|
| 1 | 7.43 | 1.86 | 26 | Present |
| 2 | 6.32 | 1.93 | 59 | Present |
| 3 | 5.20 | 1.99 | 91 | Present |
| 4 | 4.00 | 2.06 | 126 | Absent |
| 5 | 3.24 | 2.15 | 149 | Absent |
| 6 | 2.50 | 2.25 | 171 | Absent |
| 7 | 1.08 | 2.29 | 186 | Absent |
| 8 | 0.52 | 2.33 | 192 | Absent |

TABLE 2

| Test number | Frequency (wt %) of 45 μm or less | Density ($g/cm^3$) | Strength (gf) | Occurrence of crack or chip |
|---|---|---|---|---|
| 9 | 73 | 1.90 | 26 | Present |
| 10 | 62 | 2.00 | 59 | Present |
| 11 | 52 | 2.06 | 99 | Absent |
| 12 | 44 | 2.10 | 116 | Absent |
| 13 | 41 | 2.15 | 126 | Absent |
| 14 | 33 | 2.21 | 149 | Absent |
| 15 | 25 | 2.25 | 171 | Absent |
| 16 | 11 | 2.31 | 186 | Absent |
| 17 | 5 | 2.35 | 200 | Absent |

TABLE 3

| Test number | Iron content (ppm) | Density ($g/cm^3$) | Strength (gf) | Occurrence of crack or chip |
|---|---|---|---|---|
| 18 | 89 | 1.80 | 26 | Present |
| 19 | 53 | 1.96 | 80 | Present |
| 20 | 31 | 2.05 | 91 | Absent |
| 21 | 20 | 2.15 | 126 | Absent |
| 22 | 14 | 2.21 | 149 | Absent |
| 23 | 9 | 2.25 | 171 | Absent |
| 24 | 5 | 2.31 | 186 | Absent |

As shown in Table 1, when the density of the preform is 1.99 $g/cm^3$ or less, and the strength is 91 gf or less, an occurrence of a crack or chip is observed in the preform. Meanwhile, when the density of the preform is 2.06 $g/cm^3$ or more, and the strength is 126 gf or more, no occurrence of a crack or chip is observed in the preform. Therefore, according to Table 1, it is shown that when the frequency of 1000 μm or more of the ground powder is lower than 5.2 wt %, particularly, 4 wt % or less, it is possible to form a preform having a sufficient strength without any crack or chip. It is possible, by using this kind of preform, to prevent a decrease in the airtightness of a spark plug due to a filler material shortage.

As shown in Table 2, when the density of the preform is 2.00 $g/cm^3$ or less, and the strength is 59 gf or less, an occurrence of a crack or chip is observed in the preform. Meanwhile, when the density of the preform is 2.06 $g/cm^3$ or more, and the strength is 99 gf or more, no occurrence of a crack or chip is observed in the preform. Therefore, according to Table 2, it is shown that when the frequency of 45 μm or less of the ground powder is lower than 62 wt %, particularly, 52 wt % or less, it is possible to form a preform having a sufficient strength without any crack or chip. It is possible, by using this kind of preform, to prevent a decrease in the airtightness of a spark plug due to a filler material shortage.

As shown in Table 3, when the density of the preform is 1.96 $g/cm^3$ or less, and the strength is 80 gf or less, an occurrence of a crack or chip is observed in the preform. Meanwhile, when the density of the preform is 2.05 $g/cm^3$ or more, and the strength is 91 gf or more, no occurrence of a crack or chip is observed in the preform. Therefore, according to Table 3, it is shown that when the iron content is smaller than 53 ppm, particularly, 31 ppm or less, it is possible to form a preform having a sufficient strength without any crack or chip. It is possible, by using this kind of preform, to prevent a decrease in the airtightness of a spark plug due to a filler material shortage.

What is claimed is:

1. A method of manufacturing a spark plug comprising:

a metal shell having a through hole;

an insulating body held inside the through hole;

a filler layer containing talc in a space surrounded by an inner peripheral surface of the through hole and an outer peripheral surface of the insulating body, the method comprising the steps of;

recycling powder not used in a process of forming a filler layer of another spark plug in order to form the filler layer of said spark plug, said process of forming the filler layer of the other spark plug being performed after talc and a binder are mixed in the filler layer;

regulating a particle size of not used powder to form a regulated unused powder, and mixing a binder and the regulated unused powder; and removing iron from the unused powder or the regulated unused powder before mixing talc and the binder.

2. The spark plug manufacturing method according to claim 1, wherein the particle size of the unused powder is regulated such that a frequency of the unused powder of 1000 μm or more in particle size distribution is 4 wt % or less.

3. The spark plug manufacturing method according to claim 1, wherein the particle size of the unused powder is regulated such that a frequency of the unused powder of 45 μm or less in particle size distribution is 52 wt % or less.

4. The spark plug manufacturing method according to claim 1, wherein a deironized powder from which iron is removed has an iron content of 31 ppm or less.

* * * * *